US006854668B2

(12) United States Patent
Wancho et al.

(10) Patent No.: US 6,854,668 B2
(45) Date of Patent: Feb. 15, 2005

(54) EXTENDED COVERAGE ORDINARY HAZARD SPRINKLER SYSTEM

(75) Inventors: Thomas Francis Wancho, Bethlehem, PA (US); David Mann, Whitehall, PA (US)

(73) Assignee: Victaulic Company of America, Easton, PA (US)

( * ) Notice: Subject to any disclaimer, the term of this patent is extended or adjusted under 35 U.S.C. 154(b) by 70 days.

(21) Appl. No.: 10/136,270

(22) Filed: Apr. 29, 2002

(65) Prior Publication Data

US 2003/0201341 A1 Oct. 30, 2003

(51) Int. Cl.[7] ..... B05B 1/26; A62C 37/08

(52) U.S. Cl. ..... 239/498; 239/504; 239/524; 169/37; 169/41; 169/57

(58) Field of Search ..... 239/498, 504, 239/523, 524, 208, 209; 169/37, 41, 57

(56) References Cited

U.S. PATENT DOCUMENTS

| | | | | | |
|---|---|---|---|---|---|
| 306,201 | A | | 10/1884 | Worthington | 169/194 |
| 306,202 | A | | 10/1884 | Worthington | 169/194 |
| 400,688 | A | * | 4/1889 | Kersteter | 169/40 |
| 822,548 | A | | 6/1906 | Newman | 239/553 |
| 1,549,194 | A | * | 8/1925 | Gensmer | 239/222.19 |
| 1,885,219 | A | * | 11/1932 | Bills et al. | 169/37 |
| 2,279,374 | A | | 4/1942 | Jung | 239/498 |
| 2,493,982 | A | | 1/1950 | Lee | 169/37 |
| 2,550,456 | A | | 4/1951 | De Flon | 239/498 |
| 2,697,008 | A | | 12/1954 | Rowley | 239/498 |
| 2,724,614 | A | | 11/1955 | Rider | 239/498 |
| 3,015,449 | A | * | 1/1962 | Meyer | 239/417 |
| 3,195,647 | A | | 7/1965 | Campbell et al. | 169/40 |
| 3,525,402 | A | | 8/1970 | Hattori | 169/40 |
| 3,682,251 | A | | 8/1972 | Livingston | 169/37 |
| 3,702,159 | A | | 11/1972 | Livingston | 169/5 |
| 3,722,596 | A | | 3/1973 | Livingston | 169/60 |
| 3,768,736 | A | | 10/1973 | Cox | 239/504 |
| 3,770,063 | A | | 11/1973 | Juliano | 169/39 |
| 3,802,512 | A | | 4/1974 | Todtenkopf | 169/37 |
| 3,857,446 | A | | 12/1974 | Kenny | 169/60 |
| 3,874,455 | A | | 4/1975 | Klesow | 169/19 |
| 3,888,313 | A | | 6/1975 | Freeman | 169/16 |
| 3,904,126 | A | | 9/1975 | Allard | 239/502 |
| 4,066,129 | A | | 1/1978 | Anderson | 169/37 |
| 4,091,872 | A | | 5/1978 | Mountford | 169/37 |
| 4,091,873 | A | | 5/1978 | Werner | 169/37 |
| 4,099,675 | A | | 7/1978 | Wohler et al. | 239/498 |
| 4,113,021 | A | | 9/1978 | Werner | 169/37 |
| 4,128,128 | A | | 12/1978 | Mears | 169/37 |
| 4,136,740 | A | | 1/1979 | Groos et al. | 169/39 |
| D251,128 | S | | 2/1979 | Groos et al. | 023/214 |
| 4,217,960 | A | | 8/1980 | Miyazaki | 169/38 |
| 4,279,309 | A | | 7/1981 | Fischer et al. | 169/37 |
| 4,296,815 | A | * | 10/1981 | Mears | 169/37 |
| 4,405,018 | A | | 9/1983 | Fischer | 169/37 |
| 4,440,234 | A | | 4/1984 | Shea | 169/39 |

(List continued on next page.)

FOREIGN PATENT DOCUMENTS

| | | | |
|---|---|---|---|
| FR | 1252143 | 1/1961 | |
| GB | 765125 | 1/1957 | |
| GB | 1028521 | 5/1966 | |
| GB | 2177912 | 2/1987 | 169/16 |
| GB | 2206043 | 12/1988 | 169/37 |
| NL | 6400053 | 7/1964 | |

*Primary Examiner*—Patrick Brinson
(74) *Attorney, Agent, or Firm*—Abelman, Frayne & Schwab

(57) ABSTRACT

A sprinkler discharges a column of water downwardly onto a deflector that has a plurality of peripheral tines with a respective non-radial tapered notch separating each adjacent pair of tines. Opposed cutouts with tabs in the central portion of the deflector combine with the notches and with depressed peripheral tabs to produce a predetermined spray pattern.

13 Claims, 7 Drawing Sheets

U.S. PATENT DOCUMENTS

| | | | | | |
|---|---|---|---|---|---|
| 4,569,289 | A | | 2/1986 | Gielow et al. | 105/1.1 |
| 4,580,729 | A | * | 4/1986 | Pounder | 239/524 |
| 4,616,710 | A | * | 10/1986 | Pilant et al. | 169/41 |
| 4,619,327 | A | | 10/1986 | Pieczykolan | 169/38 |
| 4,624,414 | A | * | 11/1986 | Ferrazza | 239/467 |
| 4,630,682 | A | | 12/1986 | Pieczykolan | 169/38 |
| 4,657,085 | A | | 4/1987 | Jacobsen | 169/43 |
| 4,699,217 | A | | 10/1987 | McLennan et al. | 169/37 |
| 4,739,835 | A | | 4/1988 | Polan et al. | 169/38 |
| 4,785,888 | A | | 11/1988 | Blum et al. | 169/39 |
| 4,791,993 | A | | 12/1988 | Curran | 169/16 |
| 4,800,961 | A | | 1/1989 | Klein | 169/37 |
| 4,880,063 | A | | 11/1989 | Leininger et al. | 169/37 |
| 4,901,799 | A | | 2/1990 | Pepi et al. | 169/39 |
| 4,923,013 | A | | 5/1990 | De Gennaro | 169/90 |
| 4,926,946 | A | | 5/1990 | Polan | 169/37 |
| 4,930,578 | A | | 6/1990 | Barnett et al. | 169/39 |
| 4,964,574 | A | | 10/1990 | Daigle | 239/589 |
| 4,987,957 | A | * | 1/1991 | Galaszewski | 169/37 |
| 5,010,959 | A | | 4/1991 | Lostoski | 169/37 |
| 5,020,601 | A | | 6/1991 | Retzloff et al. | 169/37 |
| 5,036,923 | A | | 8/1991 | Shea, Sr. | 169/37 |
| 5,080,176 | A | * | 1/1992 | Polan et al. | 169/37 |
| 5,094,298 | A | | 3/1992 | Polan | 169/41 |
| 5,097,906 | A | | 3/1992 | Polan | 169/37 |
| D348,719 | S | | 7/1994 | Dolan | D23/214 |
| 5,366,022 | A | | 11/1994 | Meyer et al. | 169/37 |
| 5,579,846 | A | | 12/1996 | Meyer et al. | 169/37 |
| 5,584,344 | A | | 12/1996 | Meyer et al. | 169/37 |
| 5,609,211 | A | | 3/1997 | Meyer et al. | 169/37 |
| 5,664,630 | A | | 9/1997 | Meyer et al. | 169/37 |
| 5,727,737 | A | * | 3/1998 | Bosio et al. | 239/504 |
| 5,829,532 | A | | 11/1998 | Meyer et al. | 169/37 |
| 5,829,684 | A | * | 11/1998 | Fishcer | 239/524 |
| 5,839,667 | A | * | 11/1998 | Fishcer | 239/498 |
| 5,865,256 | A | * | 2/1999 | Pounder | 169/37 |
| 6,026,907 | A | * | 2/2000 | Pahila | 169/37 |
| 6,059,044 | A | * | 5/2000 | Fischer | 169/37 |
| 6,276,460 | B1 | * | 8/2001 | Pahila | 169/37 |

* cited by examiner

EXTENDED COVERAGE ORDINARY HAZARD SPRINKLER SYSTEM

FIELD OF THE INVENTION

This invention relates to a sprinkler system and to individual sprinklers within a system for extended coverage ordinary hazard applications.

BACKGROUND OF THE INVENTION

In the fire protection industry, fire sprinklers are designed for various residential and storage applications in accordance with accepted industry standards. These standards include, for example, the Standard for the Installation of Sprinkler Systems, NFPA 13, issued by the National Fire Protection Association, and Standard 199, issued by Underwriters Laboratories, Inc. Existing versions of both standards and all prior, superseded versions of both standards are incorporated by reference herein.

NFPA-13 defines various requirements for sprinkler systems used in occupied commercial or residential interior spaces or "occupancies" with different fire hazard potentials. In particular, the standard recognizes three general hazard categories for sprinkler systems: light, ordinary and extra. Light hazard occupancies are those where the quantity and/or combustibility of contents is low and fires with relatively low rates of heat release are expected. Ordinary hazard occupancies are those where the quantity and/or combustibility of contents is equal to or greater than that of light hazard, ranging from low to high, where the quantities of combustibles are moderate and stock piles do not exceed twelve feet, such that fires with moderate to high rates of heat release are expected. Extra hazard occupancies are those where the quantity and combustibility of contents is very high and flammable or combustible liquids, dust, lint or other materials are present, such that the probability of rapidly developing fires with high rates of heat release is very high.

The present invention is directed to the protection of ordinary hazard occupancies, in both commercial and residential environments, although it may also be advantageously applied to light hazard occupancies.

Standard coverage ordinary hazard sprinklers generally protect a maximum coverage area of 130 square feet. According to the guidelines in NFPA 13, extended coverage ordinary hazard sprinklers must protect from 225 to 400 square feet. The present invention is directed to this greater degree of protection, although it may also find use in standard coverage applications.

Each different sprinkler type demands a different type of water spray pattern to achieve either fire control or suppression. The different spray patterns are achieved by varying such factors as the shape of the sprinkler frame, the k-factor and the geometry of the deflector positioned below the frame for creating a spray pattern. The deflector geometry is particularly significant, since the deflector is a main component of the sprinkler assembly and to a great extent defines the size, shape, uniformity and water droplet size of the pattern.

Some conventional sprinkler designs have been characterized by incomplete patterns, lacking water of sufficient density and drop size directly under the sprinkler. This poses a severe problem if the fire should start in this location. To remedy this, other prior art sprinkler designs have peripheral slots in the deflector to permit water to descend down through the slots. However, the shape of the slots in turn caused a reduction in the size of the water drops, a condition commonly referred to as misting or mist. This condition does not provide a pattern of uniform density with water of sufficient velocity beneath the sprinkler to achieve efficient fire control. As a result, some prior art sprinkler systems formed of individual sprinklers in a rectangular layout have used spray patterns that discharge water generally horizontally and/or generally radially outward from the sprinklers in order to provide an overlap of the individual patterns to complete the overall pattern. This setup has been inefficient.

A further difficulty created by the prior art use of adjacent sprinklers with such overlapping patterns arises from the structure used to trigger the start of water delivery. Many sprinklers use a heat-sensitive trigger that starts the flow of water when the ambient temperature reaches a set level. In this way, if a fire is localized, only the sprinklers in the immediate area activate while the more distant sprinklers remain off. This reduces the demand for water and minimizes damage to the contents of the space.

On the other hands, it is then essential that the sprinklers in the immediate area timely activate. It has been found that when the adjacent sprinklers have overlapping horizontal spray patterns, the spray from one sprinkler may impinge on the trigger of an adjacent sprinkler, cooling down that trigger so that the adjacent sprinkler is slow to activate or even fails to activate at all. This represents a serious threat to fire control known as non-operation or "skipping," resulting in an uncontrolled fire.

SUMMARY OF THE INVENTION

It is therefore an object of the present invention to provide an individual sprinkler that may be combined with like sprinklers in a sprinkler system that avoids the above-described difficulties of the prior art.

It is a further object of the present invention to provide a sprinkler that offers improved fire protection for Extended Coverage Ordinary Hazard (ECOH) applications in a control mode scenario.

It is another object of the present invention to provide a sprinkler that produces a spray pattern that avoids the problem of skipping when a plurality of such sprinklers are combined in a sprinkler system.

The above and other objects are achieved by the present invention which, in one embodiment, is directed to a sprinkler including a frame having an exit orifice, through which a column of fire fighting liquid may be discharged downwardly, and a deflector positioned below the frame to at least partially intercept the column of liquid and to convert the column of liquid into a spray of droplets distributed in a predetermined pattern. The deflector has a generally planar central section having a generally circular periphery, and farther includes first and second cutouts inboard of the periphery and positioned at radially opposed positions along a diameter-of the central section. Each cutout has an edge and an inboard tab extending downwardly at a predetermined angle from that edge to partially fill the cutout, leaving an opening through which the liquid may pass.

In accordance with a further aspect of the present invention, the central section advantageously includes a plurality of tines each extending radially outwardly from a respective base at the periphery to a respective outer edge along opposed non-parallel, non-radial sides, the tines being spaced circumferentially about the periphery to define a respective tapered notch separating each adjacent pair of tines to disperse the spray of droplets at least partially in non-radial directions.

Advantageously, each tine is substantially identically shaped to taper inwardly from its outer edge to its base to define the respective tapered notch separating each adjacent pair of tines.

In accordance with yet another advantageous aspect of the present invention, the deflector includes first and second peripheral tabs that extend from the periphery and are radially opposed to each other along the diameter of the central section. The peripheral tabs incline downwardly from the central section at a second predetermined angle to depress the spray of droplets leaving the deflector in the direction of the diameter down from horizontal so as to avoid skipping.

In a preferred embodiment, the angle at which the peripheral tabs are bent is 33.45 degrees below the plane of the deflector.

In accordance with still another aspect, the present invention is directed to a sprinkler system including a plurality of the inventive sprinklers.

These and other objects, features and advantages of the present invention will be apparent from the following detailed description of the preferred embodiments taken in conjunction with the following drawings, wherein like reference numerals denote like elements.

DETAILED DESCRIPTION OF THE PREFERRED EMBODIMENTS

Figure 1:
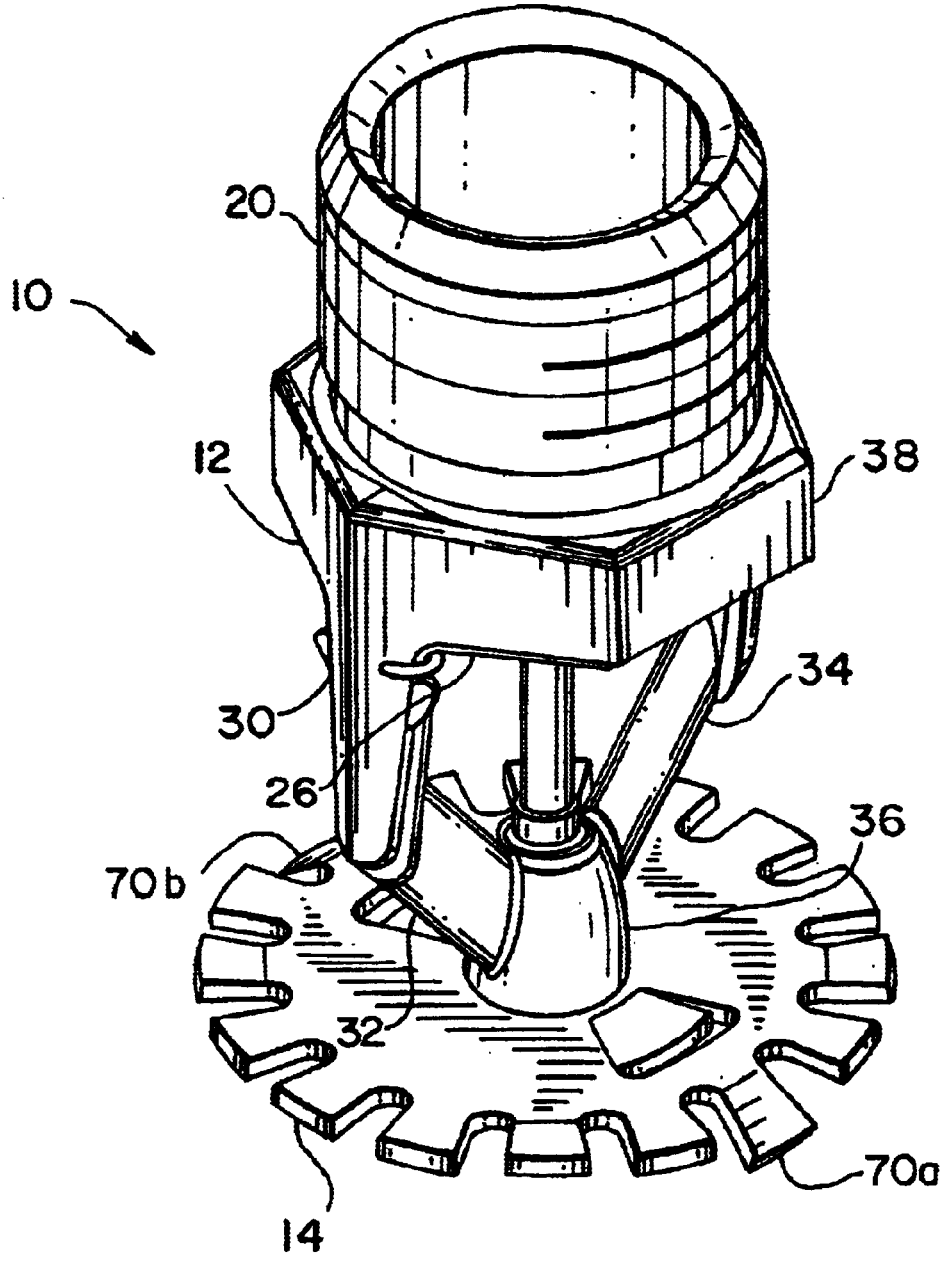
FIG. 1 is a side elevational view of a sprinkler in accordance with a preferred embodiment of the present invention.

With reference to FIG. 1, a sprinkler 10 in accordance with a preferred embodiment of the present invention has two main components: a frame 12 and a deflector 14. These two components combine to provide a more efficient sprinkler design capable of improved protection for ECOH applications, which may advantageously lead to a reduction in the number of sprinklers required to operate and adequately control a fire.

Figure 2:
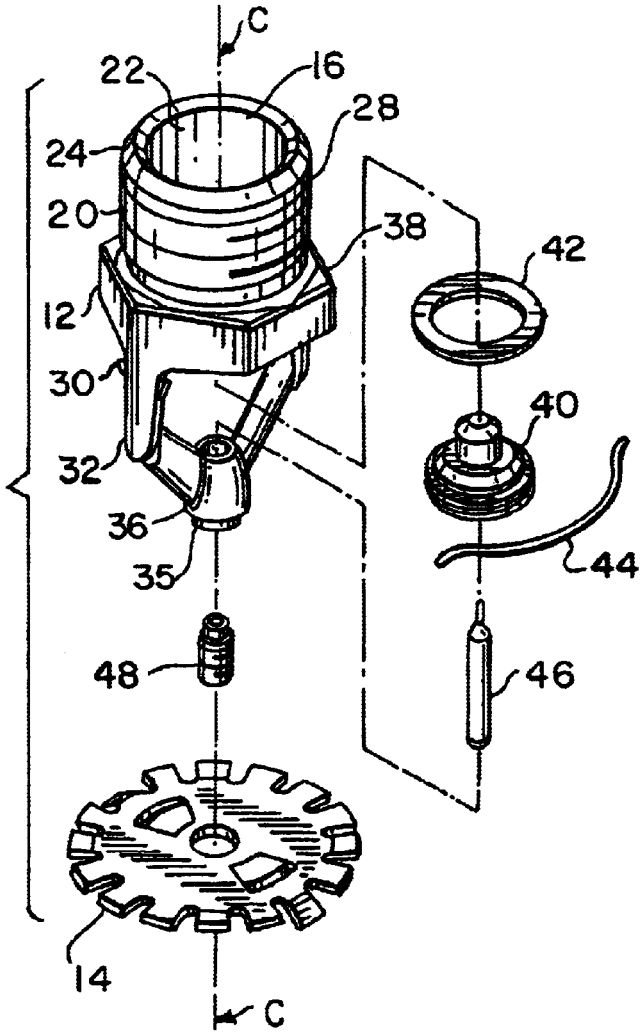
FIG. 2 is an exploded view of the sprinkler of FIG. 1.

FIG. 2 illustrates the sprinkler 10 in exploded format, with certain elements exaggerated for clarity. The frame 12 is hollow and substantially tubular at its upper portion, having an upper inlet orifice 16 for receiving a stream of fire fighting liquid (not illustrated) such as water. For convenience, the present application will refer to the liquid as water, but any appropriate flowable substance may be used.

Figure 3:
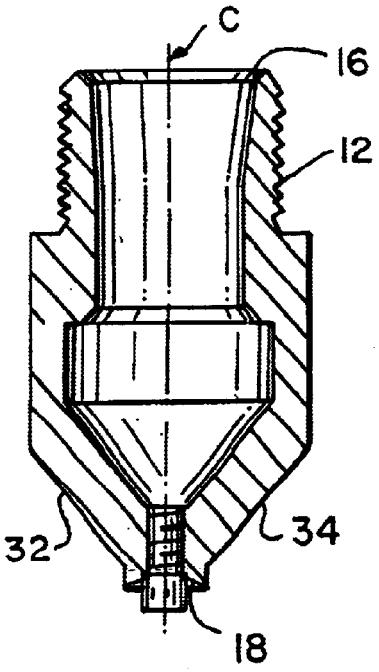
FIG. 3 is a cross-sectional view of the sprinkler frame.

As shown in FIG. 3, the frame 12 further includes a lower outlet orifice 18 through which the stream of water may be discharged downwardly. FIGS. 1 and 2 show that the deflector 14 is positioned below the frame 12 to at least partially intercept the stream of water and to convert the stream of water into a spray of water droplets distributed in a predetermined pattern.

The frame 12 includes a tubular body 20 defining an internal passageway 22 having the inlet orifice 16 at an upper inlet end 24. The lower discharge end 26 of the passageway 22 in the frame 12 forms the outlet orifice 18. Threads 28 are provided on the outside of the inlet end 24 to permit the sprinkler 10 to be coupled to a drop or supply pipe (not illustrated) for delivery thereto of water or another fire fighting liquid. The internal passageway 22 has a preferably straight central axis C.

As shown in FIG. 1, the frame 12 further includes a yoke 30 having opposed support arms 32, 34 which extend generally away from the discharge end 26 of the body 20 and meet to form a conical screw-boss 36 along the central axis C. The support arms 32, 34 and the screw-boss 36 support the deflector 14 positioned juxtaposed to, facing and spaced away from the discharge end 26 of the body 20.

While two symmetrically positioned support arms are preferred, additional support arms may be provided, preferably symmetrically positioned around and spaced away from the central axis.

The frame 12 is preferably enlarged at the discharge end 26 of the body 20 in a circumferential boss 38, preferably hexagonally shaped to allow easy tightening from many angles, reducing the assembly effort.

Sprinkler 10 further includes an operating mechanism for closing the internal passageway 22 at the outlet orifice 18 to prevent the flow of water until a fire occurs. As shown in FIG. 2, a pip cap 40 is seated within the outlet orifice 18 against a belleville seal 42. A lodgement spring 44 is provided to aid the removal of the pip cap 40 and belleville seal 42 when the sprinkler 10 activates. A heat responsive trigger in the form of a frangible glass bulb 46 is mounted to releasably retain the closure until the trigger is activated, with the upper end of the bulb 46 mounted in the pip cap 40 and the lower end fitted in a load screw 48, which also compresses the belleville seal 42. The deflector 14 is then rivetted to a lower portion 35 of the screw-boss 36 (i.e. of the frame 12) having a lesser diameter.

The bulb 46 is filled with a heat responsive liquid. During a fire, the ambient temperature rises, causing the liquid in the bulb 46 to expand. When the ambient temperature reaches the rated temperature of the sprinkler 10, the bulb 46 shatters. As a result, the passageway 22 is cleared of all sealing parts and water is discharged towards the deflector 14. The deflector 14 is designed to distribute the water in a pattern that is most effective in controlling the fire.

Other novel features of the frame 12 that provide improved water distribution are discussed below.

Figure 4:
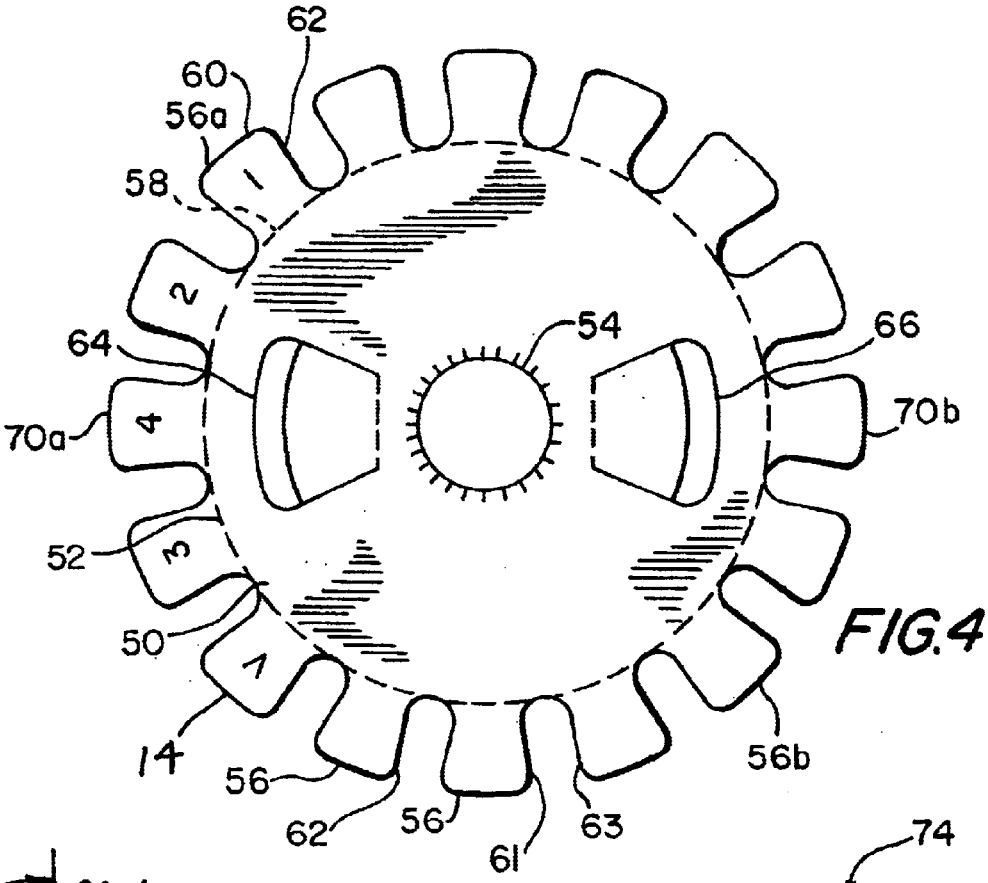
FIG. 4 is a top plan view of the deflector in the sprinkler of FIG. 1.

As shown in FIG. 4, the deflector 14 has a generally planar annular central section 50 having a generally circular periphery 52 (shown in dotted line) and a central opening 54 for connection to the screw-boss 36. A plurality of tines 56 each extend radially outwardly from a respective base 58 at the periphery 52 to a respective outer edge 60 along opposed sides 61, 63.

The tines 56 are spaced circumferentially about the periphery 52 and each tine 56 is advantageously substantially identically shaped from its outer edge 60 to its base 58 to define a respective tapered notch 62 separating each adjacent pair of tines 56. In one preferred embodiment, sixteen such tines 56 may be provided equally spaced about the periphery 52. However, in the preferred embodiment illustrated in FIG. 4, two radially opposed peripheral tabs 70*a*, 70*b* take the place of two of the tines 56, advantageously in the form of downwardly depressed ones of the tines 56, as described below.

Figure 5:
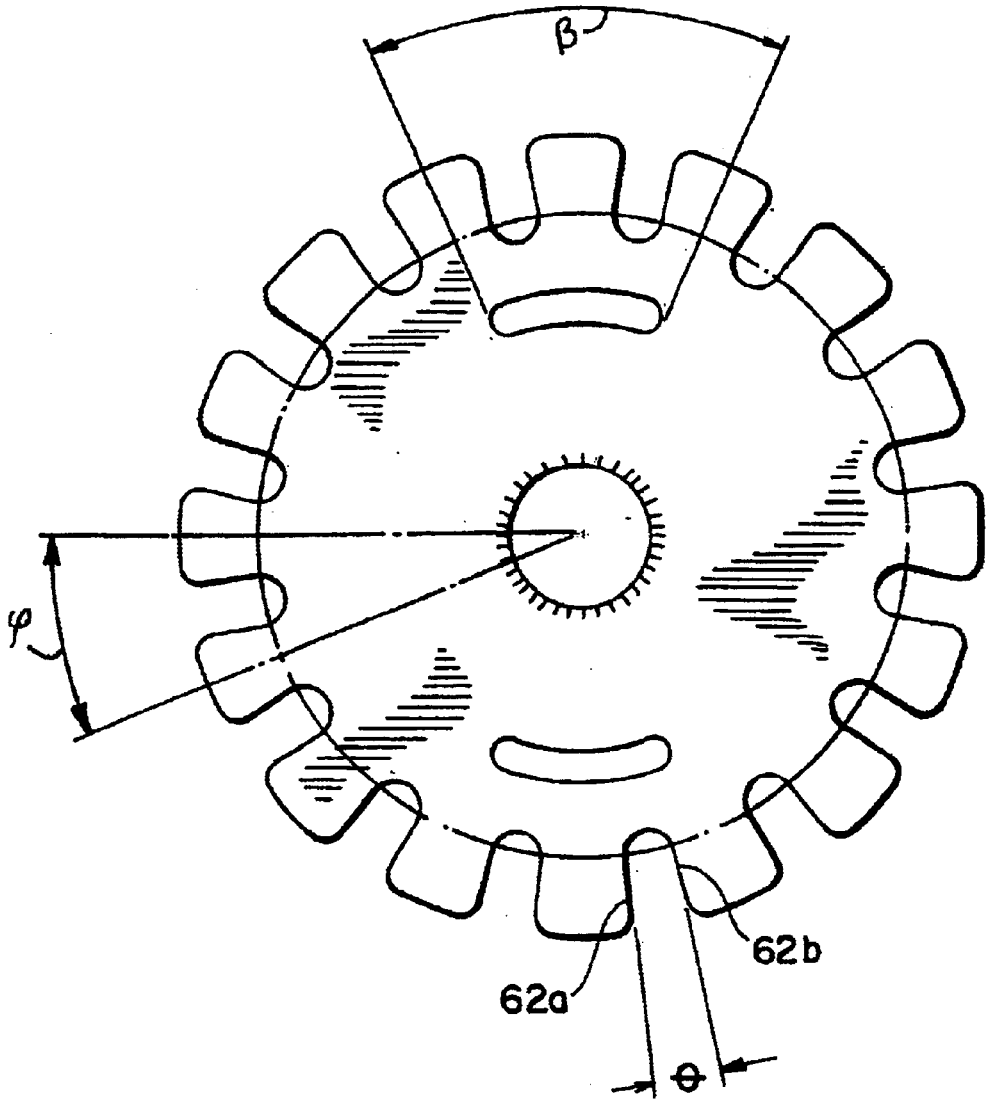
FIG. 5 is a top plan view of the deflector for illustrating certain dimensions thereof.

As shown in FIG. 4, advantageously each of the tines 56 has the same shape and each of the tapered notches 62 between adjacent pairs of tines 56 has the same shape. As shown in FIG. 5, which illustrates certain dimensions of the deflector 14, in an embodiment with sixteen tines 56 (or fourteen tines 56 and two peripheral tabs 70*a*, 70*b*), the angle $\phi$ between the center lines of adjacent tines (or tine and tab) is therefore 22.5 degrees.

In accordance with an advantageous feature of the present invention shown in FIG. 5, the interior tab sides, e.g. 62*a*, 62*b*, of each tapered notch are not parallel to each other, as are the slot faces of the prior art, nor are they radial, i.e. they do not lie along radii of the central section 50. Rather, the tab sides 62*a*, 62*b* diverge at an intermediate face angle $\theta$ that is advantageously 3.33 degrees in the illustrated embodiment. In general, face angle $\theta$ would be greater than 0 degrees (i.e. non-parallel sides) and less than 360 degrees divided by twice the number of tines 56 (including peripheral tabs) (i.e. non-radial sides). Consequently, lines extended from the sides 62*a*, 62*b* would not meet at the center of the central section 50.

The face angle $\theta$ of the tapered notches 62 improves the uniformity of the distribution pattern of drops below the deflector 14 and maintains adequate drop size. In order to achieve a comparable effect with parallel-faced slots in the periphery of a deflector as in the prior art, the overall deflector diameter may have to be increased and the slots cut deeper toward the center, which in turn creates other problems, such as misting, described above. Moreover, as opposed to radially-faced slots, water streams exiting from the notches 62 crisscross, rather than flowing generally radially outward, to create more of a blanketing water column below the deflector 14.

As shown in FIG. 4, the central section 50 includes first and second cutouts 64, 66 extending entirely through the deflector 14 axially and positioned inboard of the periphery 52 at radially opposed positions in the central section 50.

Figure 6:
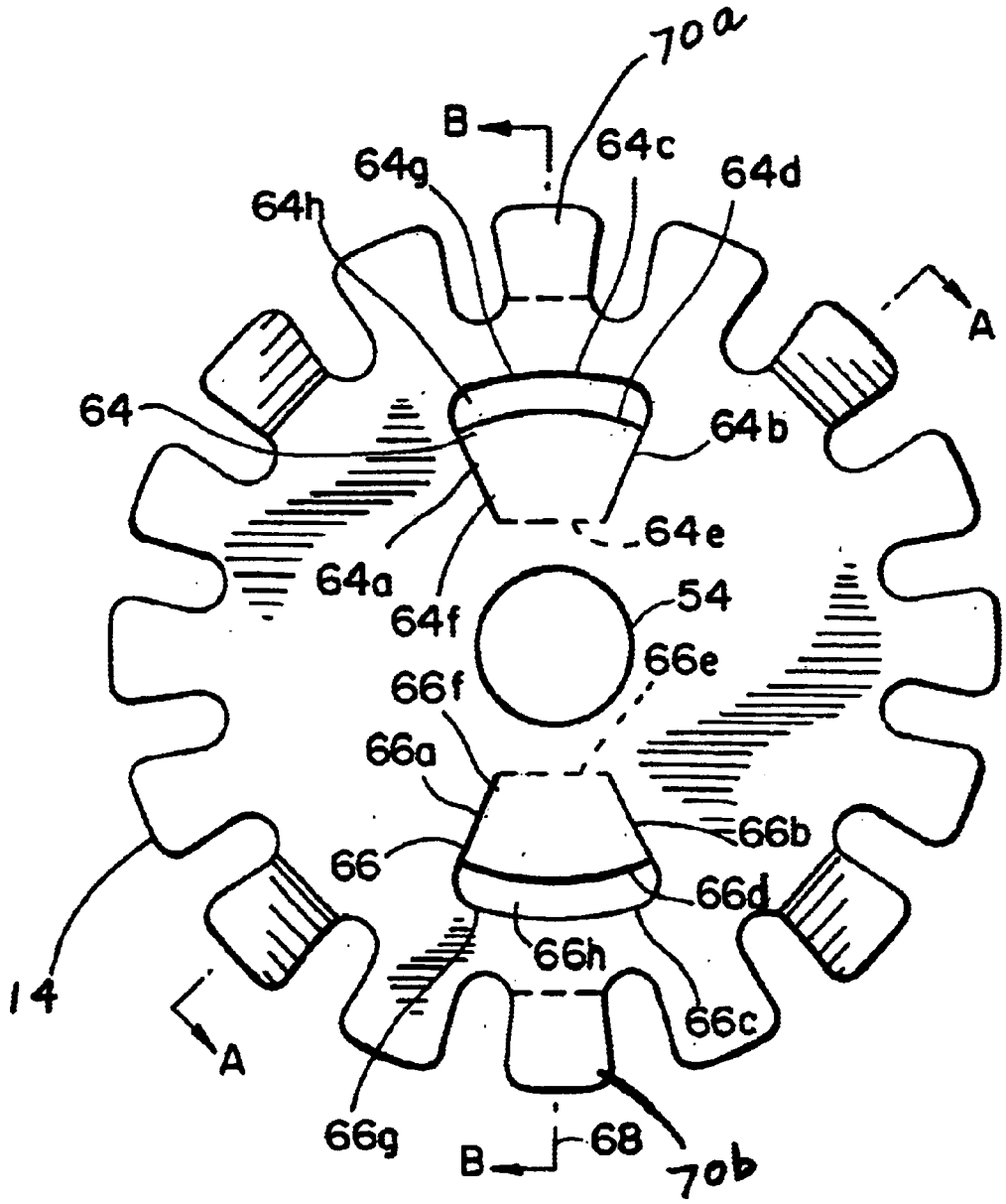
FIG. 6 is a top plan view of the deflector for illustrating inboard tabs thereof.

As shown more specifically in FIG. 6 the cutouts 64, 66 are positioned along a first diameter 68 of the central section 50 (line B—B in FIG. 6) and are advantageously in the shape of a truncated wedge, each one being formed from two radial cuts 64*a*, 64*b*, 66*a*, 66*b* and two circumferential cuts 64*c*, 64*d*, 66*c*, 66*d*. The first cutout 64 has an inner, uncut edge 64*e* (shown in dotted lines), with an inboard tab 64*f* formed from the body of the deflector 14 between the radial cuts 64*a*, 64*b*.

Figure 7:
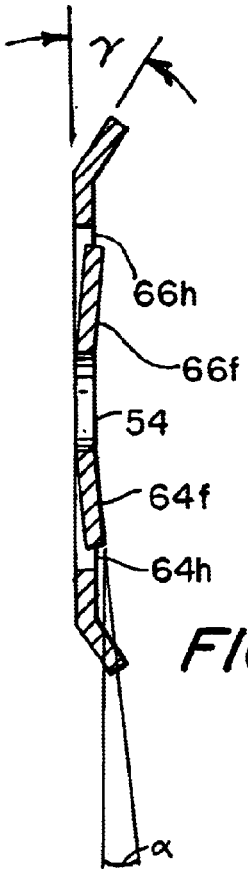
FIG. 7 is a cross-sectional view of the deflector taken along line B—B in FIG. 6.

As shown in FIG. 7, which is a cross-section taken along line B—B in FIG. 6, the inboard tab 64*f* extends downwardly at an angle $\alpha$ from the inner edge 64*e*, where angle $\alpha$ advantageously is 6.17 degrees.

The inboard tab 64*f* is truncated at its outer edge 64*g*, so that the inboard tab 64*f* only partially fills the first cutout 64, leaving an opening 64*h* in the deflector 14 in the shape of a section of an annulus. As shown in FIG. 5, the opening 64*h* subtends an angle $\beta$ of 49.8 degrees. In a deflector having a central section 1.260 inches in diameter, for example, the inboard tab 64*f* may advantageously be formed with its outer edge 64*g* at a radial distance of 0.429 inches and the circumferential cut 64*c* at a radial distance of 0.491 inches, with the opening 64*h* having a length of 0.305 inches.

The second cutout 66 has the identical structure as the first cutout 64. Thus, the second cutout 66 has an inner, uncut edge 66*e* (shown in dotted lines), with an inboard tab 66*f* formed from the body of the deflector 14 between the radial cuts 66*a*, 66*b* extending downwardly at the angle $\alpha$ from the inner edge 66*e*. The inboard tab 66*f* is truncated at its outer edge 66*g*, so that the inboard tab 66*f* only partially fills the second cutout 66*h*, leaving an opening 66*h* in the deflector 14 with the same shape as opening 64*h*.

In the prior art, the only tabs on the deflector were the peripheral tabs defined by the material between the peripheral slots. In contrast, the inboard tabs 64*f*, 66*f* are formed inboard of the conventional location and provide water beneath the sprinkler 10 with adequate drop size and momentum to ensure fire control.

For an extended coverage sprinkler system, the maximum spacing between sprinklers is a 20×20 foot spacing. Particularly when the sprinklers in the system are spaced at or near the 20×20 foot allowable spacing, there is minimal overlap from the adjacent sprinklers, and therefore conventional designs have less water directly below each sprinkler. In the present invention, on the other hand, the inboard tabs 64*f*, 66*f* allow water to flow through the center of the deflector 14, thus applying water to the floor area directly under the sprinkler 10.

Moreover, the tapered notches 62 working together with the cutouts 64, 66 with tabs 64*f*, 66*f* will supply an even water distribution that avoids the breakdown in drop size.

As noted above, a further aspect of the present invention as shown in FIG. 1 is embodied in two peripheral tabs 70*a*, 70*b*, also lying along the diameter 68 shown in FIG. 6. As illustrated in FIG. 7, these peripheral tabs 70*a*, 70*b* are bent downwardly, i.e. in the same direction as the inboard tabs 64, 66, at an angle $\gamma$ selected to remove the problem of skipping by depressing the spray distribution along this direction, rather than giving a generally horizontal spray distribution. The peripheral tabs 70*a*, 70*b* may also be termed impingement tabs (or tines), since they help control the degree of impingement of the spray of one sprinkler upon an adjacent sprinkler mounted along a continuation of the diameter 68. Advantageously, the peripheral tabs 70*a*, 70*b* are bent down at an angle sufficient to prevent impingement of the spray on the trigger of the adjacent sprinkler. In a preferred embodiment, the angle $\gamma$ is 33.45 degrees below the flat plane of the deflector 14.

It has been found that when the peripheral tabs 70*a*, 70*b* are aligned with diameter 68, it is unnecessary to have corresponding peripheral tabs at 90 degrees thereto, due to the presence of the frame arms 32, 34. However, additional peripheral tabs for depressing the spray distribution down from horizontal may be added wherever appropriate.

Figure 8:
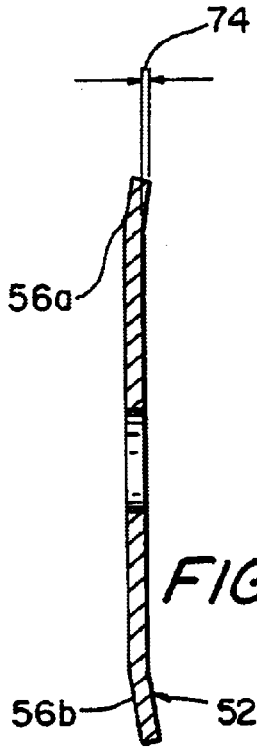
FIG. 8 is a cross-sectional view of the deflector taken along line A—A in FIG. 6.

In a still further development, two radially opposed ones of the tines 56, labeled 56*a*, 56*b*, lying along a different diameter 72 are bent at the periphery 52 of the central section 50 by a small angle above the flat plane of the deflector 14, i.e. in the opposite direction to the inboard tabs 64, 66. This angle creates a 0.02 inch offset 74 from the horizontal, which is shown in FIG. 8, which is a cross-sectional view taken along line B—B in FIG. 6, i.e. along diameter 72. As shown in FIG. 4, the upwardly bent opposed tines 56*a*, 56*b* are advantageously spaced from the downwardly bent peripheral tabs 70*a*, 70*b* with one flat tine 56 therebetween.

The inboard tabs 64*f*, 66*f*, the tapered notches 62 and the peripheral tabs 70*a*, 70*b* result in a unique deflector design that optimizes the water dispersion area of coverage without compromising the droplet size or impinging on adjacent sprinklers. This results in a more efficient sprinkler design capable of improved protection for ECOH applications thus reducing the number of sprinklers required to operate and adequately control a fire.

Figure 9:
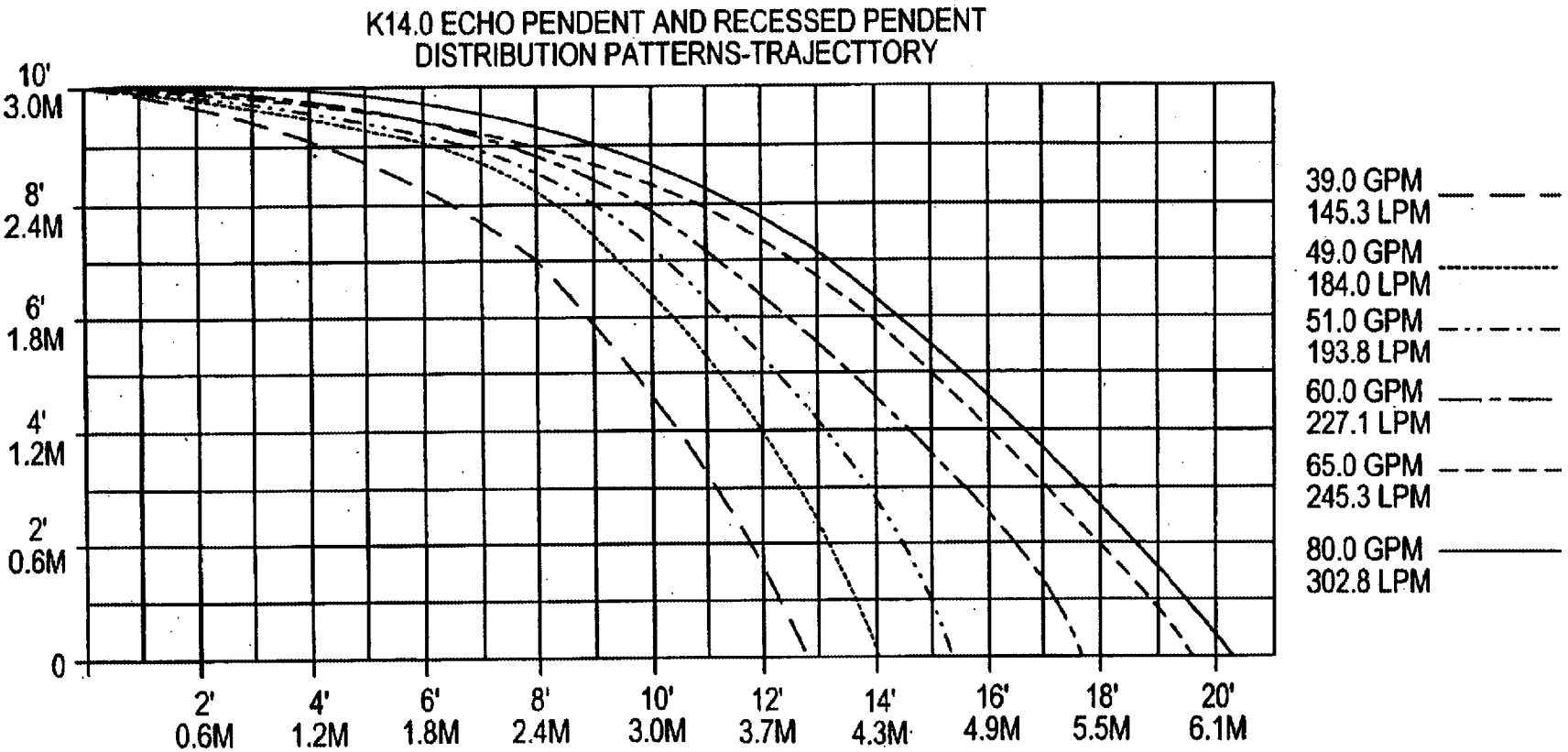
FIG. 9 is a graph of water drop trajectories.

FIG. 9 illustrates the distribution patterns achieved by sprinklers designed in accordance with the present invention. FIG. 9 is a graph of the trajectories of the outermost water drops discharged from the sprinklers along the diameter 68, i.e. in the intended direction of an adjacent sprinkler, showing the area of coverage and the shape of the patterns for different pressures, i.e. gallons per minute (GPM). As shown therein, even at the highest water pressure, corresponding to the solid line, at 12 feet out the height of the water drops has fallen by 2 feet, from 10 feet to 8 feet. Therefore, the water drops from the sprinkler shown will not impinge on the trigger of the adjacent sprinkler 12 feet away and therefore will not artificially cool the ambient temperature detected in the case of a fire.

Figure 10:
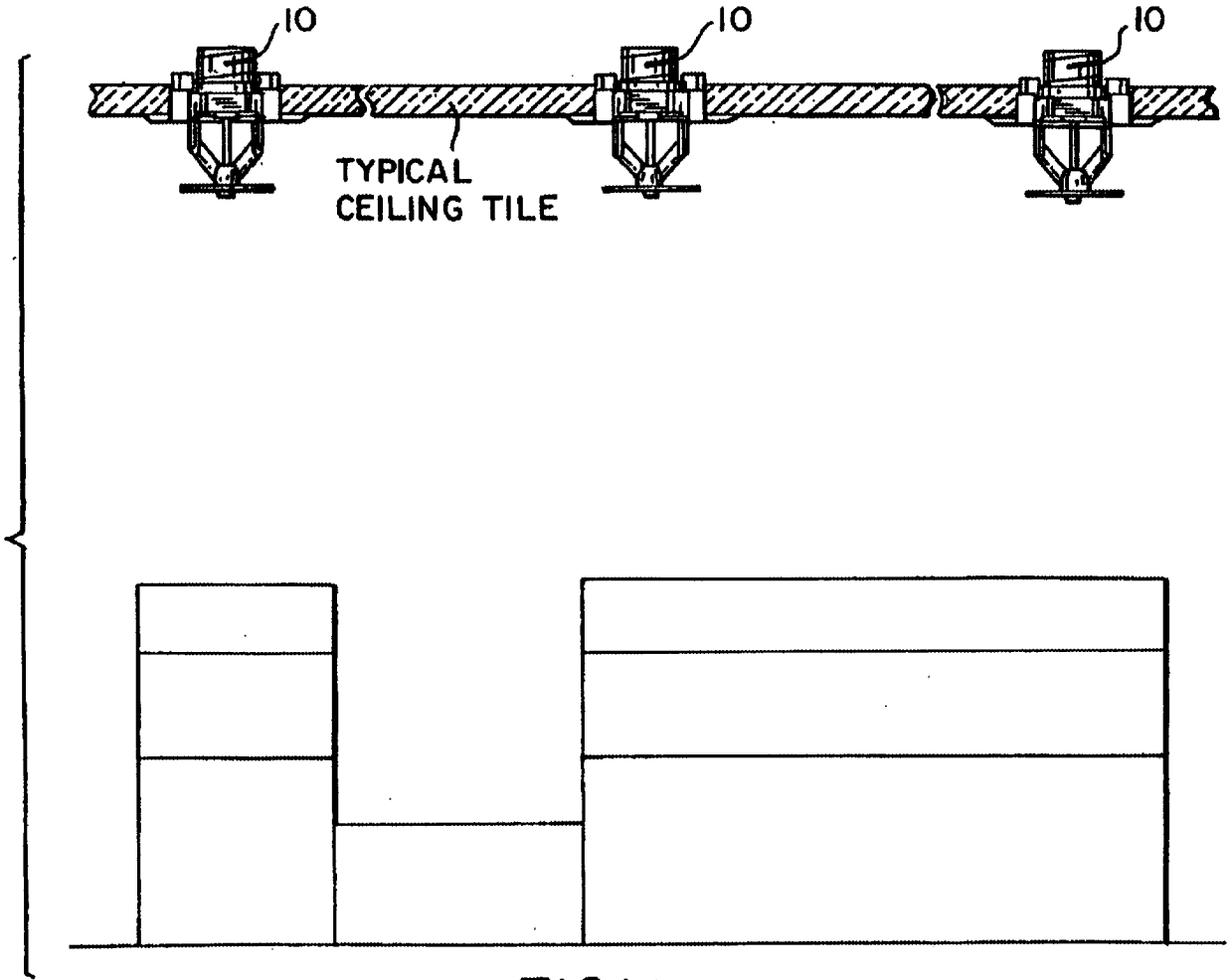
FIG. 10 is a schematic view of a sprinkler system incorporating a plurality of sprinklers in accordance with the present invention.

FIG. 10 schematically illustrates a sprinkler system incorporating a plurality of the individual inventive sprinklers 10, spaced apart by a distance of, for example, 12 to 20 feet for an ECOH application.

While the above discussion has concentrated on the structure of the deflector 14, the frame 12 is also advantageously structured with regard to its frame shadow. Frame shadow occurs when the frame arms of a sprinkler cause continuous divergence of the water flow column as it passes the frame arm on the way to the deflector. Frame 12 exhibits little or no frame shadow, resulting in a uniform floor wetting and wall wetting distribution pattern, thus improving the potential fire control efficiency of the sprinkler 10 while conserving water flow.

To accomplish this result, for a frame having a height of $1\frac{13}{16}$ inches from the top of the boss 36 to the lower surface of the deflector 14, the frame 12 has the following structure:

1. The included internal angle between the arms 32, 34 must be between 51 and 120 degrees, preferably 80 degrees.
2. The included external angle of the arms 32, 34 must match the included internal angle.
3. The cross-section of each arm 32, 34 must be of an airfoil type shape with a width to thickness ratio of 1.5–2.4:1, preferably 2:1.
4. The thickness of each arm 32, 34 must be less than approximately 0.160 inches, preferably 0.120 inches.
5. The screw-boss 36 must have a conical shape with a small diameter at the screw 48 of 0.200–0.300 inches, preferably 0.250 inches. Its large diameter at the deflector must be 0.300–0.400 inches, preferably 0.375 inches. It must have a straight cylindrical portion at the deflector 14 of length 0.200–0.400 inches, preferably 0.240 inches.
6. The frame arm inside and outside edges must be as close to sharp as possible, with a 0–0.060 inch radius, preferably 0.015 inches. The edges of the arms must also blend into the screw-boss 36 on the inside at the small diameter of the screw-boss 36 so as not to cause a step, shelf or edge.
7. The frame arms must extend significantly outside the cylindrical water column to prevent interference with the straight portion of the frame arms.
8. The screw 48 must have a smooth cylindrical diameter of 0.100–0.200 inches, preferably 0.150 inches. It must have a length of 0.040–0.100 inches, preferably 0.070 inches. The screw 48 must also protrude from the inside surface on the screw-boss 36 by 0.04–0.120 inches, preferably 0.070 inches. The screw 48 must have a non-chamfered or sharp edge facing the lower orifice 18.

These geometrical relationships are scalable to larger and smaller sizes.

The combination of these features is key to achieving the desired non-shadow discharge pattern. The elimination of one or more of these features will begin to allow the water column to diverge, thus creating a frame shadow.

While the disclosed apparatus has been particularly shown and described with respect to the preferred embodiments, it is understood by those skilled in the art that various modifications in form and detail may be made therein without departing from the scope and spirit of the invention. Accordingly, modifications such as those suggested above, but not limited thereto are to be considered within the scope of the invention, which is to be determined by reference to the appended claims.

We claim:

1. A sprinkler, comprising:

a frame having an exit orifice through which a column of fire fighting liquid may be discharged downwardly; and a deflector positioned below said frame to at least partially intercept the column of liquid and to convert the column of liquid into a spray of droplets distributed in a predetermined pattern, said deflector having a generally planar central section having a generally circular periphery, said central section further including first and second cutouts inboard of said periphery and positioned at radially opposed positions along a diameter of said central section, said first cutout having a first edge and a first inboard tab extending downwardly at a first predetermined angle from said first edge to partially fill said first cutout, leaving a first opening through which the liquid may pass, and said second cutout having a second edge and a second inboard tab extending downwardly at said first predetermined angle from said second edge to partially fill said second cutout, leaving a second opening through which the liquid may pass, said deflector further including first and second peripheral tabs that extend from said periphery and are radially opposed to each other along a diameter of said central section, each said peripheral tab extending downwardly from said central section at a second predetermined angle to depress the sray of droplets leaving said deflector in the direction of said diameter down from horizontal so as to avoid skipping.

2. The sprinkler of claim 1, wherein said deflector further includes a plurality of tines each extending radially outwardly from a respective base at said periphery to a respective outer edge along opposed non-radial sides, said tines being spaced circumferentially about said periphery to define a respective tapered notch separating each adjacent pair of tines and said sides on either side of each said notch being non-parallel to disperse said spray of droplets at least partially in non-radial directions.

3. The sprinkler of claim 2, wherein said opposed sides of each said notch define an angle therebetween that is less than 360° divided by twice the number of tines.

4. The sprinkler of claim 1, wherein said deflector further includes a plurality of tines each extending radially outwardly from a respective base at said periphery to a respective outer edge along opposed non-radial sides, said tines being spaced circumferentially about said periphery to define a respective tapered notch separating each adjacent pair of tines and said sides on either side of each said notch being non-parallel to disperse said spray of droplets at least partially in non-radial directions.

5. The sprinkler of claim 4, wherein said opposed sides of each said notch define an angle therebetween that is less than 360° divided by twice the number of tines.

6. A sprinkler, comprising:

a frame having an exit orifice through which a column of fire fighting liquid may be discharged downwardly; and a deflector positioned below said frame to at least partially intercept the column of liquid and to convert the column of liquid into a spray of droplets distributed in a predetermined pattern, said deflector having a generally planar central section having a generally circular periphery, said deflector further including a plurality of tines each extending radially outwardly from a respective base at said periphery to a respective outer edge along opposed non-radial sides, said tines being spaced circumferentially about said periphery to define a respective tapered notch separating each adjacent pair of tines and said sides on either side of each said notch being non-parallel to disperse said spray of droplets at least partially in non-radial directions, said deflector including first and second peripheral tabs that extend from said peripheral and are radially opposed to each other alone a diameter of said central section, each said peripheral tab extending downwardly from said central section at a predetermined angle to depress the spray of droplets leaving said deflector in the direction of said diameter down from horizontal so as to avoid skipping.

7. The sprinkler of claim 6, wherein said opposed sides of each said notch define an angle therebetween that is less than 360° divided by twice the number of tines.

8. The sprinkler of claim 6, wherein said deflector further includes first and second peripheral tabs that extend from said periphery and are radially opposed to each other along a diameter of said central section, each said peripheral tab extending downwardly from said central section at a predetermined angle to depress the spray of droplets leaving said deflector in the direction of said diameter down from horizontal so as to avoid skipping.

9. A sprinkler, comprising:

a frame having an exit orifice through which a column of fire fighting liquid may be discharged downwardly; and a deflector positioned below said frame to at least partially intercept the column of liquid and to convert the column of liquid into a spray of droplets distributed in a predetermined pattern, said deflector having a generally planar central section having a generally circular periphery, said central section further including first and second cutouts inboard of said periphery and positioned at radially opposed positions along a diameter of said central section, said central section further including first and second peripheral tabs that extend from said periphery and are radially opposed to each other along a diameter of said central section, each said peripheral tab extending downwardly from said central section at a predetermined angle to depress the spray of droplets leaving said deflector in the direction of said diameter down from horizontal so as to avoid skipping.

10. A sprinkler system comprising a plurality of sprinklers mounted in spaced relation to provide coverage over an area, each said sprinkler comprising:

a frame having an exit orifice through which a column of fire fighting liquid may be discharged downwardly; and a deflector positioned below said frame to at least partially intercept the column of liquid and to convert the column of liquid into a spray of droplets distributed in a predetermined pattern, said deflector having a generally planar central section having a generally circular periphery, said central section further including first and second cutouts inboard of said periphery and positioned at radially opposed positions along a diameter of said central section, said first cutout having a first edge and a first inboard tab extending downwardly at a first predetermined angle from said first edge to partially fill said first cutout, leaving a first opening through which the liquid may pass, and said second cutout having a second edge and a second inboard tab extending downwardly at said first predetermined angle from said second edge to partially fill said second cutout, leaving a second opening through which the liquid may pass, said deflector further including first and second peripheral tabs that extend from said periphery and are radially opposed to each other alone a diameter of said central section, each said peripheral tab extending downwardly from said central section at a second predetermined angle to depress the spray of droplets leaving said deflector in the direction of said diameter down from horizontal so as to avoid skipping.

11. A sprinkler system comprising a plurality of sprinklers mounted in spaced relation to provide coverage over an area, each said sprinkler comprising:

a frame having an exit orifice through which a column of fire fighting liquid may be discharged downwardly; and a deflector positioned below said frame to at least partially intercept the column of liquid and to convert the column of liquid into a spray of droplets distributed in a predetermined pattern, said deflector having a generally planar central section having a generally circular periphery, said deflector further including a plurality of tines each extending radially outwardly from a respective base at said periphery to a respective outer edge along opposed non-radial sides, said tines being spaced circumferentially about said periphery to define a respective tapered notch separating each adjacent pair of tines and said sides on either side of each said notch being non-parallel to disperse said spray of droplets at least partially in non-radial directions, said deflector including first and second peripheral tabs that extend from said periphery and are radially opposed to each other along a diameter of said central section, each said peripheral tab extending downwardly from said central section at a predetermined angle to depress the spray of droplets leaving said deflector in the direction of said diameter down from horizontal so as to avoid skipping.

12. A sprinkler system comprising a plurality of sprinklers mounted in space relation to provide coverage over an area, each said sprinkler comprising:

a frame having an exit orifice through which a column of fire fighting liquid may be discharged downwardly; and a deflector positioned below said frame to at least partially intercept the column of liquid and to convert the column of liquid into a spray of droplets distributed in a predetermined pattern, said deflector having a generally planar central section having a generally circular periphery, said central section further including first and second cutouts inboard of said periphery and positioned at radially opposed positions along a diameter of said central section, said central section further including first and second peripheral tabs that extend from said periphery and are radially opposed to each other along a diameter of said central section, each said peripheral tab extending downwardly from said central section at a predetermined angle to depress the spray of droplets leaving said deflector in the direction of said diameter down from horizontal so as to avoid skipping.

13. A sprinkler, comprising:

a frame having an exit orifice through which a column of fire fighting liquid may be discharged downwardly, said frame further having a yoke with first and second support arms each having an upper straight portion, said frame further having a screw-boss suspended from said first and second arms; and a deflector positioned below said frame and supported by said screw-boss with a load screw to at least partially intercept the column of liquid and to convert the column of liquid into a spray of droplets distributed in a predetermined pattern, said deflector having a generally planar central section having a generally circular periphery, said central section including first and second cutouts inboard of said periphery and positioned at radially opposed positions along a diameter of said central section, said deflector further including first and second peripheral tabs that extend from said periphery and are radially opposed to each other along a diameter of said central section, each said peripheral tab extending downwardly from said central section at a predetermined angle to depress the spray of droplets leaving said deflector in the direction of said diameter down from horizontal so as to avoid skipping, wherein, for a scalable relationship to said frame having a height of about $1\frac{13}{16}$ inches;

a) an included internal angle between said first and second arms is between about 51 and about 120 degrees, b) an included external angle of said first and second arms matches said included internal angle, c) a cross-section of each said arm is of an airfoil type shape with a width to thickness ratio of about 1.5–2.4:1, d) a thickness of each said arm is less than approximately 0.160 inches, e) said screw-boss has a conical shape with a small diameter at said load screw of about 0.200–0.300 inches, said screw-boss further having a large diameter at said deflector of about 0.300–0.400 inches and a straight cylindrical portion at said deflector of length about 0.200–0.400 inches, f) each said arm has inside and outside edges with an about 0–0.060 inch radius, said edges blending into the screw-boss on the inside at said small diameter of the screw-boss so as not to cause a step, shelf or edge, g) said arms extend significantly outside an expected perimeter of the water column to prevent interference with a straight portion of said arms, and h) said load screw has a smooth cylindrical diameter of about 0.100–0.200 inches and a length of about 0.040–0.100 inches, said load screw protruding from the inside surface on the screw-boss by about 0.04–0.120 inches and having a non-chamfered or sharp edge facing said exit orifice.

* * * * *